US008150085B2

(12) United States Patent
Martikainen

(10) Patent No.: US 8,150,085 B2
(45) Date of Patent: Apr. 3, 2012

(54) REFLEX LOUDSPEAKER STRUCTURE

(75) Inventor: Ilpo Martikainen, Mäntylahti (FI)

(73) Assignee: Genelec Oy, Iisalmi (FI)

( * ) Notice: Subject to any disclaimer, the term of this patent is extended or adjusted under 35 U.S.C. 154(b) by 883 days.

(21) Appl. No.: 12/083,077

(22) PCT Filed: Oct. 4, 2006

(86) PCT No.: PCT/FI2006/050426

§ 371 (c)(1),
(2), (4) Date: Jul. 16, 2008

(87) PCT Pub. No.: WO2007/039671

PCT Pub. Date: Apr. 12, 2007

(65) Prior Publication Data

US 2009/0268934 A1 Oct. 29, 2009

(30) Foreign Application Priority Data

Oct. 5, 2005 (FI) ..... 20051001

(51) Int. Cl.
*A47B 81/06* (2006.01)
*H04R 1/02* (2006.01)

(52) U.S. Cl. ..... 381/332; 381/334; 381/336; 181/198; 181/199

(58) Field of Classification Search ..... D14/210, D14/204, 214, 217, 221; 181/198, 199, 148; 381/345, 346, 349, 160, 87, 332, 334, 336
See application file for complete search history.

(56) References Cited

U.S. PATENT DOCUMENTS

| | | | | |
|---|---|---|---|---|
| 3,687,221 | A * | 8/1972 | Bonnard | 181/180 |
| 5,004,105 | A | 4/1991 | Freadman | |
| 5,046,104 | A * | 9/1991 | Kloss | 381/335 |
| 5,092,424 | A | 3/1992 | Schreiber et al. | |
| 5,176,281 | A * | 1/1993 | Fiore | 220/520 |
| 5,533,097 | A * | 7/1996 | Crane et al. | 455/552.1 |
| 6,073,770 | A * | 6/2000 | Park | 206/522 |
| 7,039,210 | B2 * | 5/2006 | Holland | 381/334 |
| 2002/0085730 | A1 | 7/2002 | Holland | |
| 2004/0104069 | A1 * | 6/2004 | Martikainen | 181/156 |
| 2004/0264728 | A1 * | 12/2004 | Sperle et al. | 381/386 |
| 2006/0201739 | A1 * | 9/2006 | Tanaami | 181/156 |

FOREIGN PATENT DOCUMENTS

| | | | |
|---|---|---|---|
| EP | 0322686 | A2 | 7/1989 |
| FR | 2737074 | A1 | 1/1997 |
| GB | 2411539 | A | 8/2005 |
| JP | 5123213 | A | 5/1993 |
| JP | 6-27956 | | 2/1994 |
| JP | 2005-033513 | | 2/2005 |
| JP | 2005-51605 | | 2/2005 |
| WO | WO-2005/053355 | A2 | 6/2005 |

* cited by examiner

*Primary Examiner* — Anh Mai
(74) *Attorney, Agent, or Firm* — Birch, Stewart, Kolasch & Birch, LLP

(57) ABSTRACT

The invention relates to a reflex loudspeaker construction (1, 2, 3), which comprises a loudspeaker chamber (30) delimited by the reflex loudspeaker construction (1, 2, 3), a reflex channel (5) connected to the loudspeaker chamber (30), which connects the loudspeaker chamber (30) to the external space of the reflex loudspeaker construction (1, 2, 3), and at least one loudspeaker element (7) connected to the reflex loudspeaker construction (1, 2, 3), which forms part of the structure delimiting the loudspeaker chamber (30). According to the invention, the reflex loudspeaker construction (1, 2, 3) comprises at least two components (2, 3), which can be repeatedly detached at least partly from each other, without dismantling, in order to use the loudspeaker chamber (30) as a transportation space.

11 Claims, 6 Drawing Sheets

Fig. 7
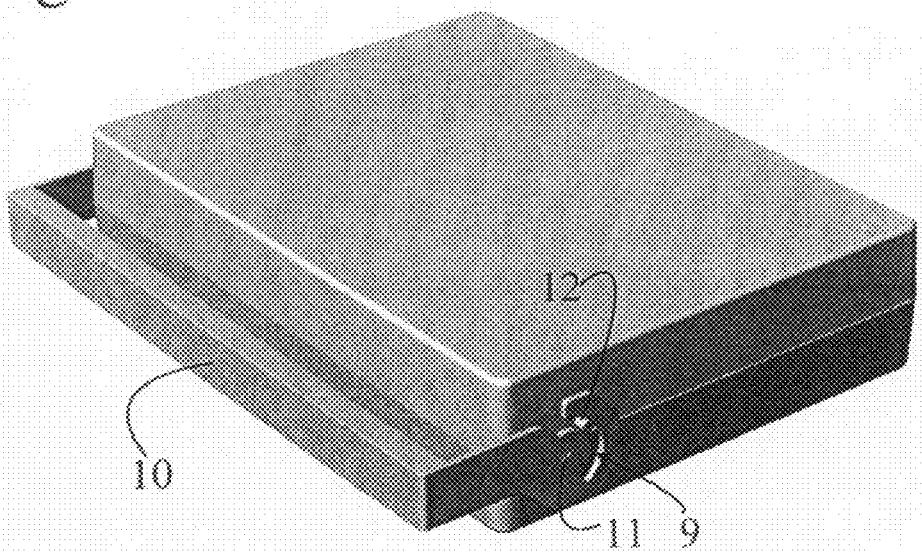
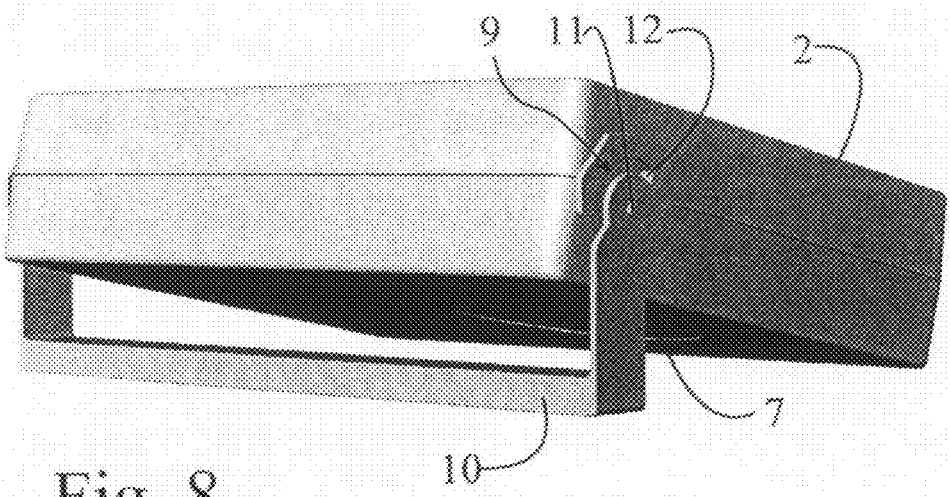
Fig. 8

REFLEX LOUDSPEAKER STRUCTURE

The present invention relates to a reflex loudspeaker construction according to the preamble of claim 1.

The invention is used particularly in connection with bass loudspeakers to create a so-called sub-woofer loudspeaker, in connection with a loudspeaker system.

The most important demands set for a loudspeaker enclosure at low operating frequencies relate to an ability to withstand pressure differences with the least possible deformations (stiffness), and a freedom from structural resonance. Usually the enclosure is made from flat sheets, which if necessary are supported and stiffened inside the enclosure.

One principle for an enclosure when reproducing low frequencies is a bass-reflex enclosure. In it, besides an opening for the loudspeaker element, there is also a second opening, to which a tube is often attached. The air in the tube creates an acoustic inductance (mass), while the air inside the enclosure for its part creates a capacitance (spring), the resonance frequency of this combination being dimensioned to operate with the loudspeaker enclosure. At low frequencies, the combination is resonant, so that the resonance circuit loads the loudspeaker element. The motion deviation of the element is then small and most of the radiation takes place through the reflex opening. When seeking to reproduce very low frequencies, the resonance frequency of the combination must be lowered, which takes place by increasing either the volume of the enclosure, or the acoustic mass of the quantity of air in the reflex channel. A large enclosure size is often a drawback, and is therefore avoided, thus unavoidably lengthening the reflex channel. Because at the resonance frequency radiation thus takes place through the reflex channel, the desired acoustic power will affect the flow velocity of the air in the tube. If the flow velocity in the tube becomes too great, the flow will become turbulent, causing extraneous sounds and compression. The minimum cross-sectional surface of the tube will therefore also depend on the desired acoustic power. When a greater acoustic power is desired, the cross-sectional surface is increased, but at the same time the tube becomes longer. A straight long tube will no longer fit inside the enclosure and is usually bent into various angles, but the sharp bends cause turbulence even at low flow velocities. Electro-technical solutions for the dimensioning of reflex loudspeakers and the related problems are described widely in the literature and disclosed in, among others, European patent EP 0 322 686.

A drawback of traditional reflex loudspeakers has been their large size and weight. This has become a problem, especially in portable operation.

GB patent application 2411539 discloses a briefcase equipped with a loudspeaker, which briefcase when closed acts as a loudspeaker enclosure. Compared to reflex loudspeakers, closed enclosures are not as efficient as reflex loudspeakers. This leads to a large power consumption, or alternatively to a modest acoustic output power.

The present invention is intended to eliminate the defects of the state of the art disclosed above and for this purpose create an entirely new type of reflex loudspeaker construction.

The invention is based on forming the reflex loudspeaker in a openable structure, for example, a briefcase. Locations for auxiliary loudspeakers, which are typically used to produce the uppermost frequencies of human hearing, are reserved in the acoustic space of the loudspeaker. The auxiliary loudspeakers are also used to create the desired properties in stereo or multi-channel operation.

One application of the invention is thus a portable sound-reproduction apparatus.

According to one preferred embodiment of the invention, the openable loudspeaker construction is a briefcase, the handle of which acts as a means for locking the loudspeaker enclosure and sealing it in the operating position.

According to one preferred embodiment of the invention, the loudspeaker is equipped with an amplifier.

More specifically, the reflex loudspeaker according to the invention is characterized by what is stated in the characterizing portion of claim 1.

Considerable advantages are gained with the aid of the invention.

A sound-reproduction apparatus intended for portable use can be made very small, but nevertheless of high quality. Particularly the reproduction of low sounds can be implemented with high quality and with good efficiency. During transportation, the loudspeakers for the other ranges of audible sound can be conveniently placed inside the reflex loudspeaker.

In a preferred embodiment of the invention, the sealing that is important to the operation of the loudspeaker can be ensured with the aid of a locking arrangement of the handle structure.

The construction is further optimized by the fact that the reflex channel is part of the structure that stiffens the loudspeaker unit. Turbulence is minimized due to the spiral, gently shaped reflex channel while this in turn reduces extraneous sounds and compression. In addition, in several variations according to the invention it is possible to achieve solutions that are very economical in terms of manufacturing technique, because in the loudspeaker construction there are typically only 2-3 important structural components in addition to the loudspeaker element.

In the following, the invention is examined with the aid of examples of applications according to the accompanying drawings.

Figure 1:
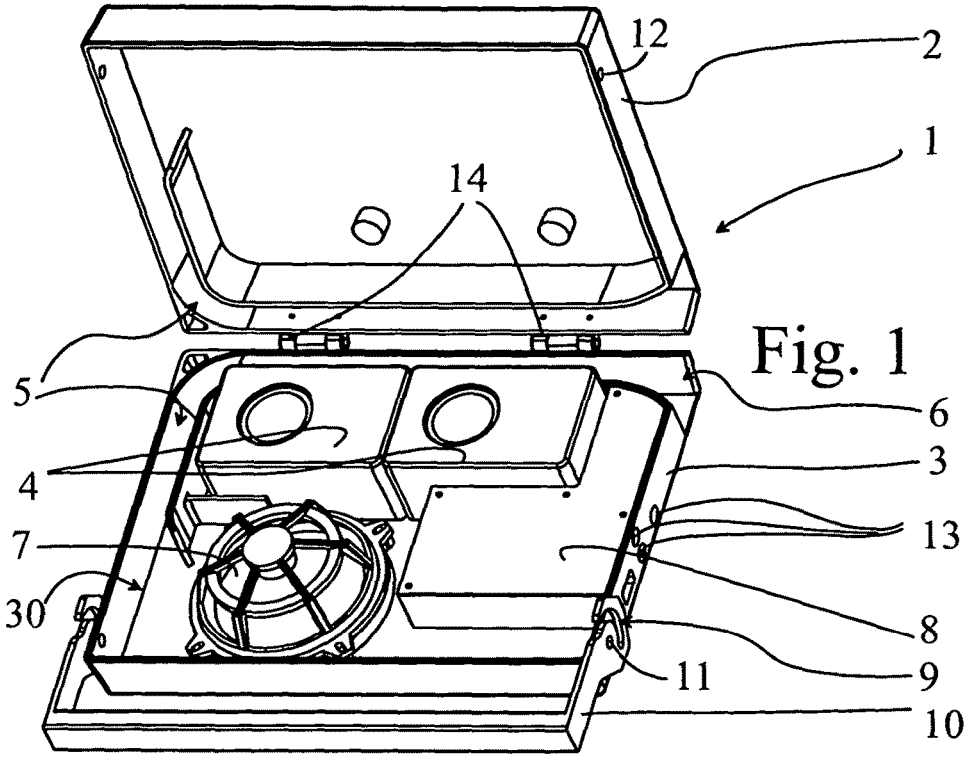
FIG. 1 shows a perspective view of one opened reflex loudspeaker according to the invention, seen from the front and at an angle.
Figure 2:
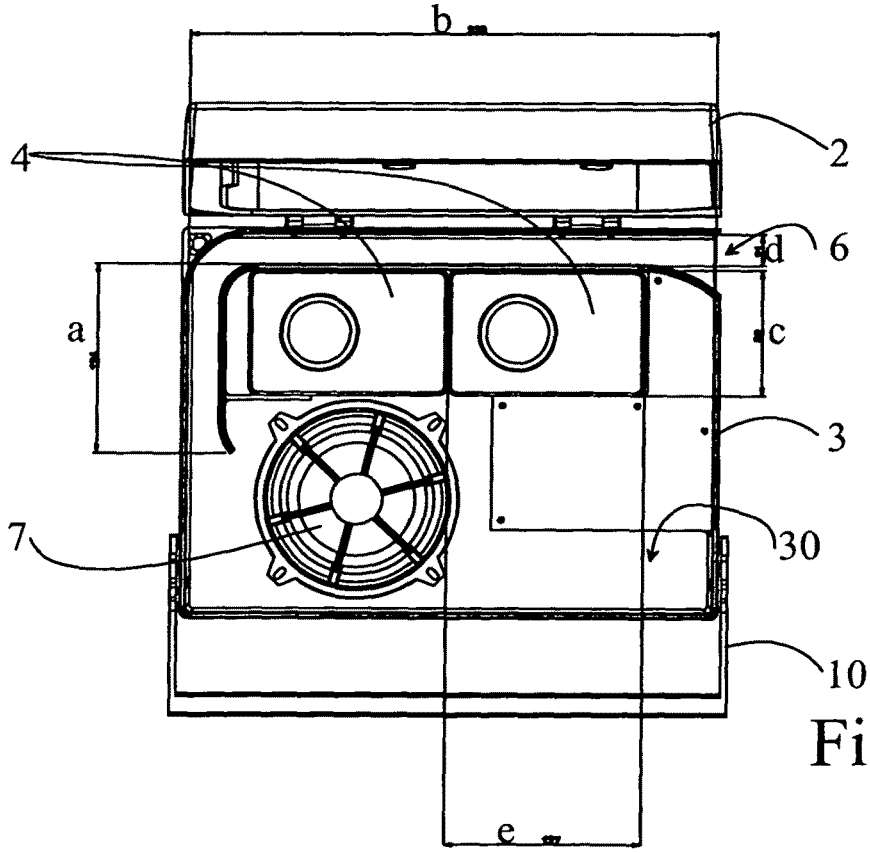
FIG. 2 shows a side top view of the loudspeaker according to FIG. 1.
Figure 4A:
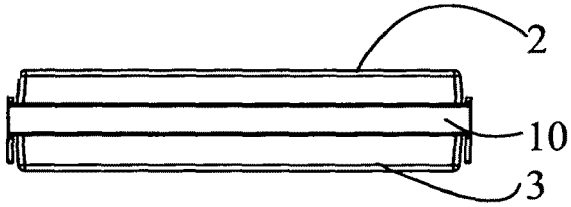

FIG. 4*a* shows a front view of the loudspeaker according to FIG. 1.

Figure 4B:
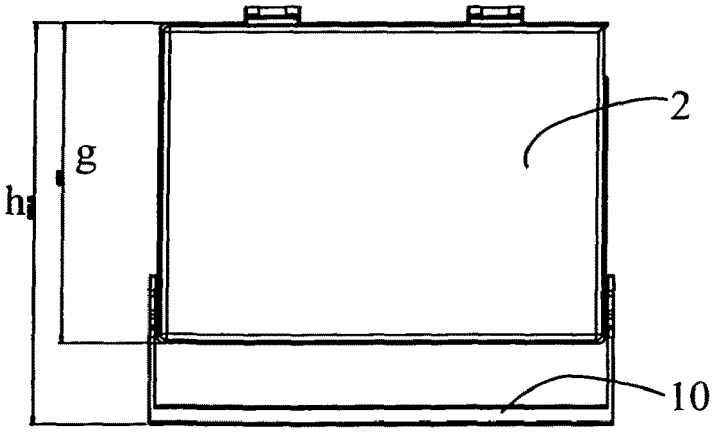

FIG. 4*b* shows a top view of the loudspeaker according to FIG. 1.

Figure 5:
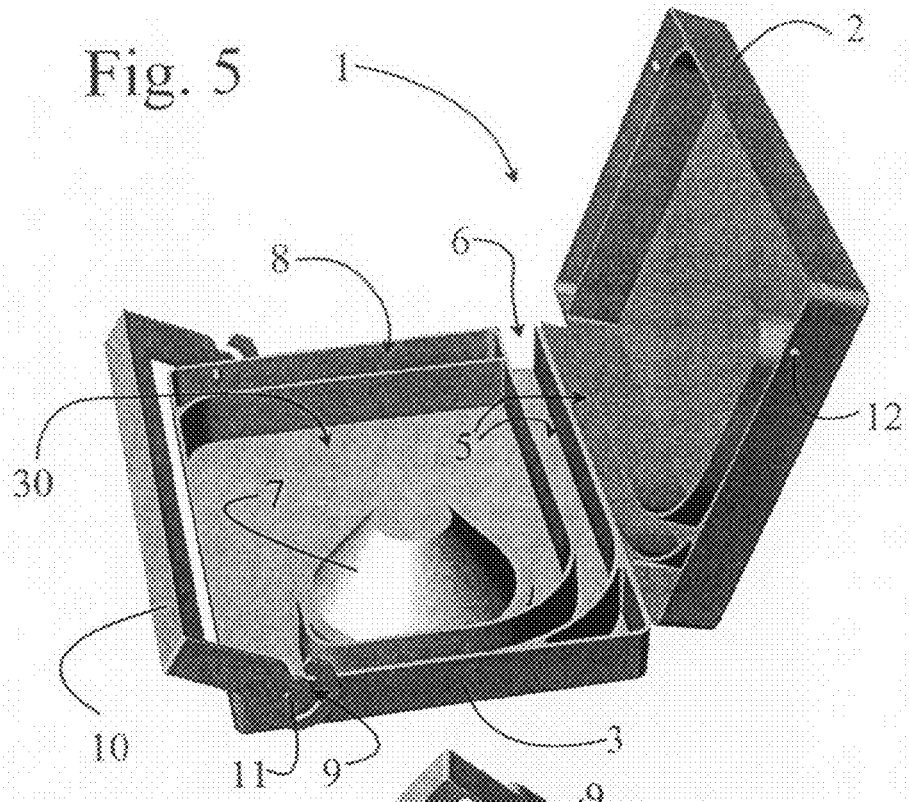

FIG. 5 shows a schematic perspective view of a second loudspeaker according to the invention, in the opened position.

Figure 6:
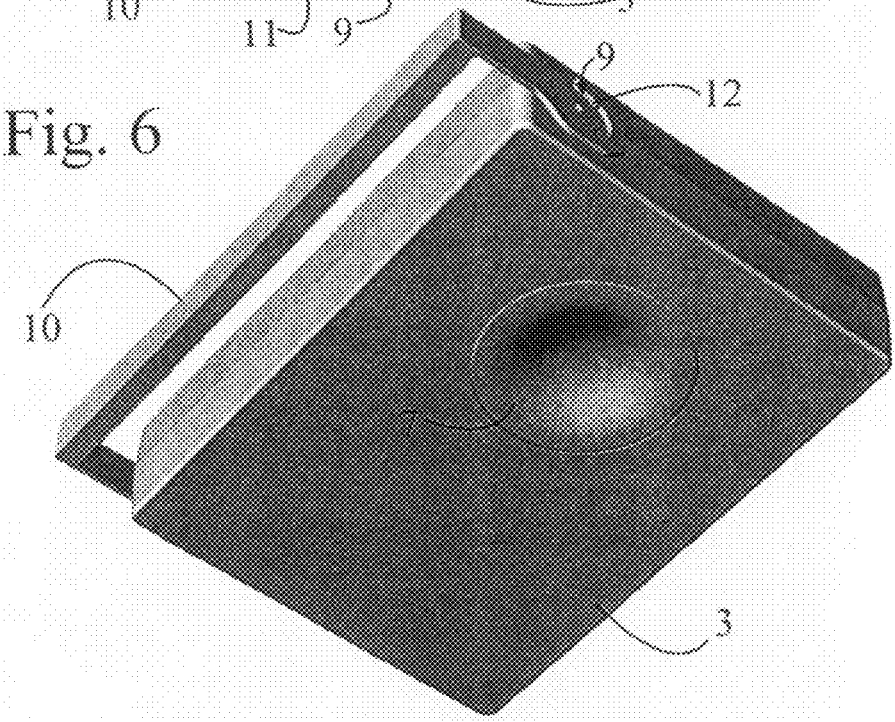

FIG. 6 shows a perspective view of the loudspeaker according to FIG. 5, in the closed position.

FIG. 7 shows a side perspective view of the loudspeaker according to FIG. 5, in the closed position.

FIG. 8 shows a side perspective view of the loudspeaker according to FIG. 5, closed and locked in its operating position with the aid of the handle.

Figure 9:
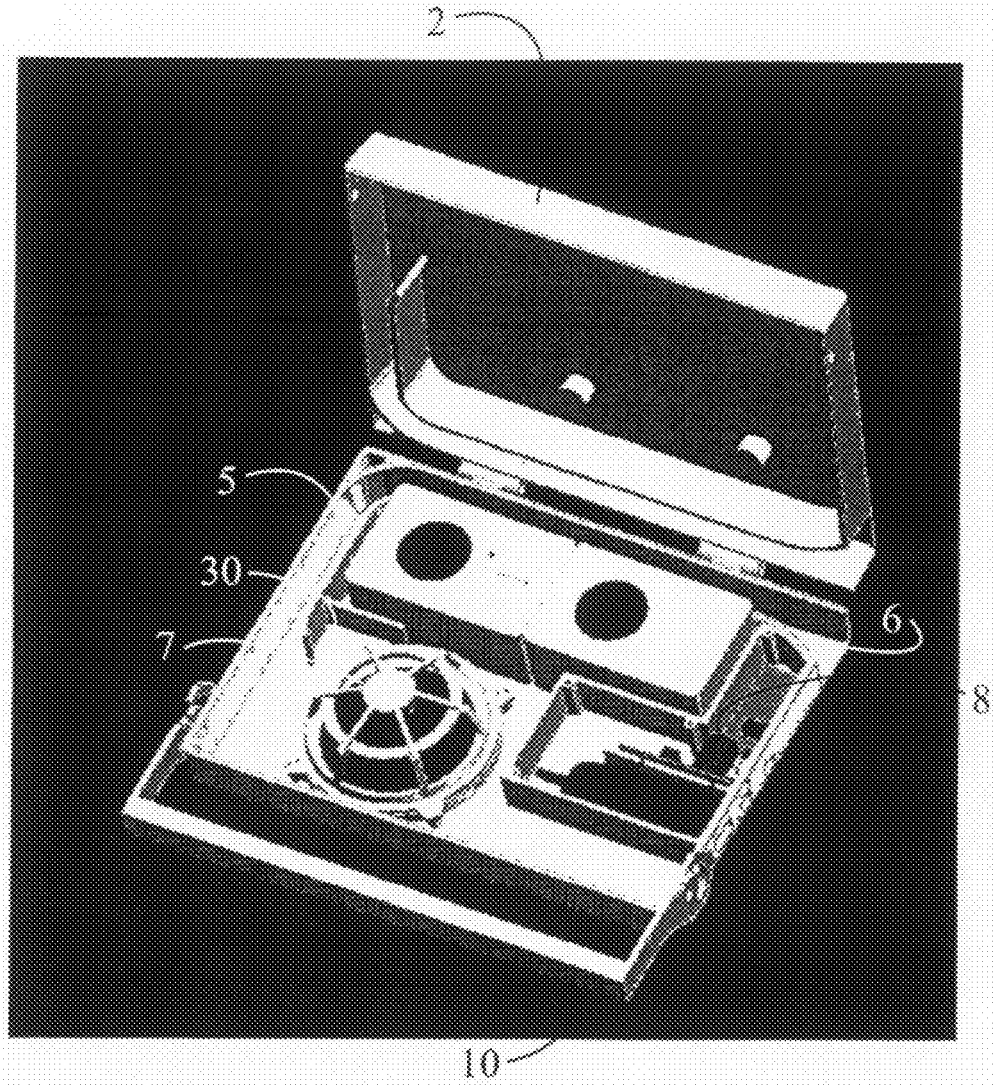

FIG. 9 shows a perspective view of a third loudspeaker construction according to the invention, when opened.

Figure 10:
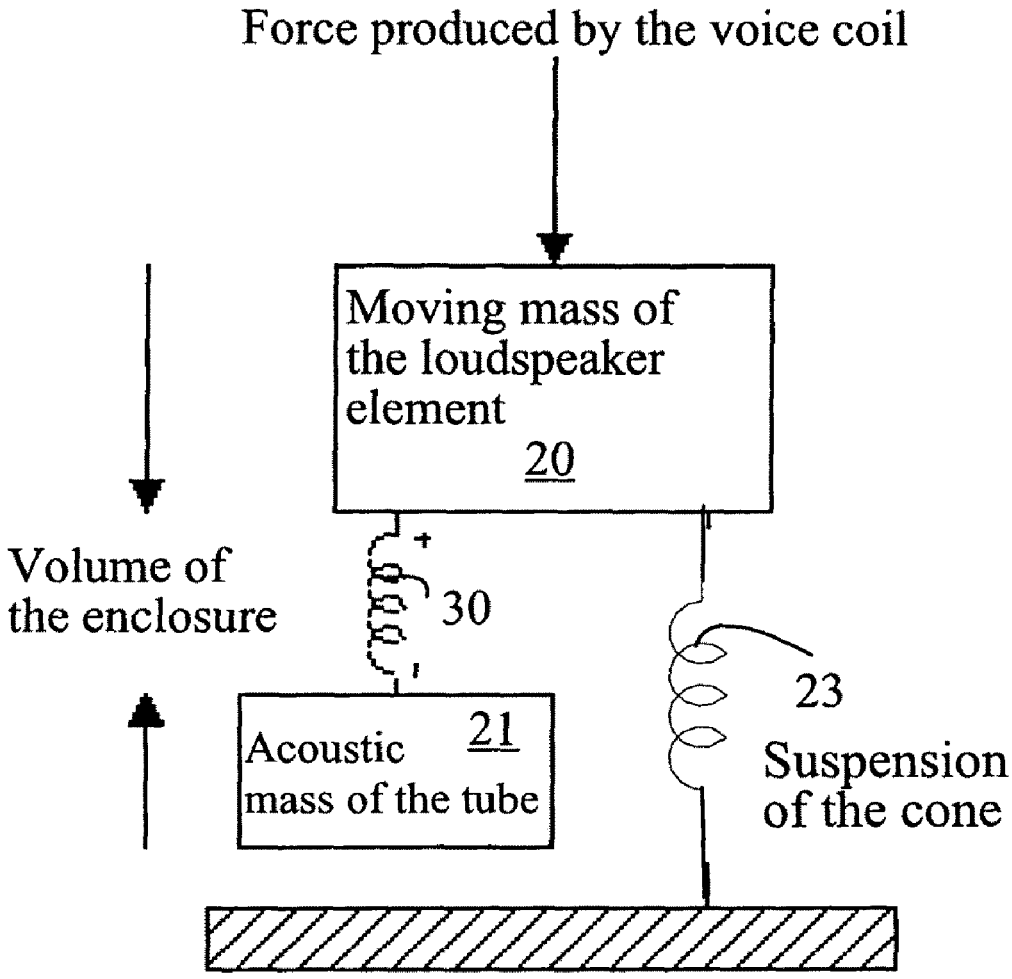

FIG. 10 shows schematically the elements used for modelling a reflex loudspeaker.

In the application, the following terminology will be used, together with their reference numbers:

1 reflex loudspeaker construction
2 cover part
3 base part
4 auxiliary loudspeakers
5 reflex channel

6 reflex opening
7 loudspeaker element
8 amplifier
9 securing slot
10 handle
11 handle attachment point
12 cover locking pin
13 connectors
14 hinges
20 moving mass of the loudspeaker element
21 acoustic mass of the tube
22 cubic capacity of the enclosure
23 suspension of the cone
30 loudspeaker chamber According to FIG. 1, the bass reflex loudspeaker construction 1 is divided into a cover component 2 and a base component 3. The loudspeaker element 7 is attached to the base component 3. The location of the loudspeaker element 7 means that, in the operating situation, it is mechanically protected under the loudspeaker construction 1. The handle 10 too is attached to the base component 3. The handle 10 is hinged to the base component by means of pins 11. A locking slot 9, which in the closed position of the loudspeaker construction 1 tightens onto the cover's 2 locking pin 12, is formed in the handle component 10. An amplifier 8, preferably enclosed in a sealed case, is also located in the base component. Also located in the base component 3 is part of the reflex tube 5, which in the closed position of the loudspeaker construction 1, however, consists of a combination of the structures of the base component 3 and the cover component, and terminates in the reflex opening 6. Spaces are also reserved in the base component 3 for auxiliary loudspeakers 4. A light locking, which will hold the auxiliary loudspeakers 4 in place during transport, can also be combined with the spaces. When the auxiliary loudspeakers are removed from their places, a loudspeaker chamber 30, the volume of which is an important dimensioning parameter for a reflex loudspeaker, is formed inside the closed construction.

The following are a few example dimensions with the marking of FIGS. 2-4*b*:

| | |
|---|---|
| dimension a of the reflex tube: | 124 mm |
| loudspeaker construction 1 width b: | 339 mm |
| auxiliary loudspeaker width c: | 82 mm |
| reflex tube width d: | 21 mm |
| auxiliary loudspeakers' n height e: | 127 mm |
| loudspeaker construction 1 thickness f: | 80 mm |
| loudspeaker construction depth g: | 256 mm |
| loudspeaker construction with handle h: | 320.5 mm |

Figure 3:
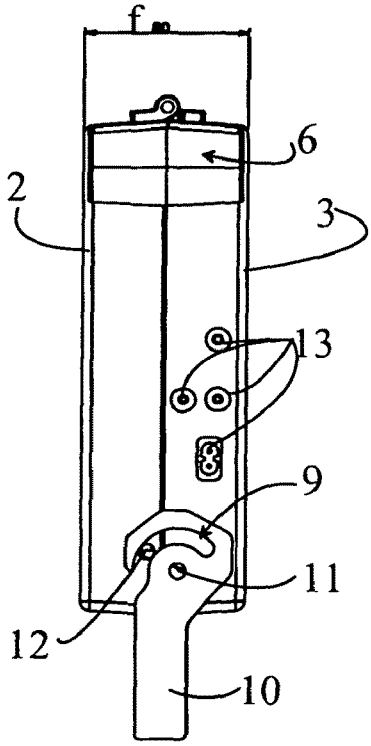
FIG. 3 shows a side view of the reflex loudspeaker according to FIG. 1, when it is closed.

FIG. 3 shows more details of the handle's 10 locking mechanism, which consists of a slot 9, onto which the locking pin 12 of the cover locks. When the handle is rotated counterclockwise in the direction of FIG. 3, the pin moves forwards in the slot 9. The right-hand edge of the slot 9 is arranged to be closer to the attachment pin 11 than the left-hand edge, so that when the handle is rotated counterclockwise, the cover component 2 tightens towards the base component 3, thus sealing the loudspeaker construction. The slot 9 is thus slightly spiral relative to the attachment pin 11. FIG. 3 also shows the connectors 13, which typically comprise connectors for the auxiliary loudspeakers 4 and also a connector for an external power supply.

FIG. 5 shows the position of the handle 10, in which the slot 9 receives the locking pin 12 of the cover. FIG. 8 in turn shows the operating position of the loudspeaker construction 1, in which the handle 10 has pressed the cover component 2 shut with the slot 9. The handle 10 also acts as a support and provides a free acoustic space for the loudspeaker element 7.

An alternative construction to the solution according to FIG. 5 is one in which when viewed from the handle component, there is a pin in the handle 10, is a pin located on the end of an arm behind the attachment point 11, which acts with the corresponding slot structure of the second part, functionally in the same way as the construction of FIG. 5.

It will be obvious to one versed in the art, that the locations of the said tightening mechanisms can vary from the cover component to the base component, as long as the operating principle of the tightening remains the same.

FIG. 9 shows a construction according to the invention, in which the amplifier component 8 is shown without a cover.

Within the scope of the invention, the location of the loudspeaker element 7 can be in either the cover 2 or the base component 3. Similarly, the handle component 10 can be attached to either component. Also the amplifier 8 be attached to either component. The reflex tube too can be moved to either part in the construction which can be opened. The location construction shown in FIGS. 1-9 offers some advantages. By means of the component location shown, the cover structure can be made simple while dividing the reflex tube between both parts achieves a large tube diameter.

In the following, the dimensioning of the reflect enclosure is described with reference to FIG. 10.

The reflex enclosure of the loudspeaker element can be illustrated by a mass-spring system, which depicts qualitatively the operating principle of the loudspeaker.

The reflect tube 5 built in the briefcase enclosure 1 consists of a Helmholtz resonator with the air volume of the loudspeaker chamber 30. The resonance arises from the effect of the acoustic air mass 21 of the tube and the series resonance circuit created by the acoustic compliance of the air volume of the loudspeaker chamber 30 of the enclosure. Close to the resonance frequency, the Helmholtz resonator amplifies the back radiation produced by the loudspeaker element. The enclosure-tube system 30, 21 is subject to resonance at a frequency, which, as is known, can be derived from the air volume of the enclosure's loudspeaker chamber 30, the diameter of the tube 5, and its length.

$$f_0 = \frac{c}{2\pi}\sqrt{\frac{A}{LV}}$$

in which $f_0$ is the resonance frequency, c is the speed of sound, A is the cross-sectional area of the tube, L is the length of the tube, and V is the volume of the enclosure.

The internal volume of the briefcase sub-woofer 1 is determined on the basis of practice, as it is desired that the external dimensions of the loudspeaker will correspond to those of a conventional briefcase. The net volume of the loudspeaker chamber 30 thus remains 3.8 litres, when the volume of the amplifier and the resonance tube are deducted from the rest of the internal volume.

When selecting the length of the reflex tube 5, the functionally detrimental resonances have to be taken into consideration. The tube 5 can be described as an acoustic transfer line, which transports a plane wave. At the mouth 6 of the reflex tube 5, the discontinuity of the volume velocity causes resonance.

The lowest detrimental resonance of a tube equipped with an infinite flange arises at the frequency $$f_0 = \frac{c}{2(l + 0.85R)},$$

in which c is the speed of sound, l is the length of the reflex tube 5, and R is the radius of the reflex tube. The other detrimental resonances of the tube are harmonic multiples of the lowest resonance frequency. The satellite loudspeakers (auxiliary loudspeakers 4) to be connected to the briefcase sub-woofer set a requirement for the upper limit (about 250 Hz) of the reproduction band of the sub-woofer. The length of the reflex tube is selected to be as long as possible, but nevertheless such that the first detrimental resonance arises only above the reproduction band of the sub-woofer. The length of the tube is selected as 48 cm, in which case the first resonance arises at the frequency 357 Hz.

Finally, in dimensioning a suitable compromise is sought between the surface area of the tube 5 and the tuning frequency of the enclosure. The cross-sectional surface area of the tube 5 must be sufficiently large for turbulence sounds not to arise. On the other hand, an increase in the surface area will mean increasing the length of the tube, if it is wished not to alter the tuning frequency. 14 $cm^2$ is selected as the cross-sectional surface area of the reflex tube. Thus 48 Hz is obtained as the tuning frequency of the briefcase sub-woofer.

The loudspeaker construction according to FIG. 1-9 can be either an independent so-called sub-woofer intended only for bass reproduction, or alternatively part of a loudspeaker solution covering the entire audio frequency range.

Typically, the loudspeaker solution according to the invention can also include an amplifier.

Even though the examples describe only one loudspeaker element 7 attached to the loudspeaker construction 1, there can also be several, within the scope of the invention.

The parts 2 and 3 of the loudspeaker construction can also be entirely detachable from each other, with the aid of two locking handles or similar.

In the present application, the term repeatedly detachable without dismantling the parts 2 and 3 of the loudspeaker construction refers, for example, to hinge or catch attachments.

In terms of manufacturing technique, the main components of the loudspeaker construction 1 can preferably be manufactured, for example, from plastic using the injection-moulding technique.

Within the scope of the invention, structures manufactured from aluminium are also advantageous, on account of their lightness and stiffness.

The cover 2 and the base part 3 are referred in the aforementioned texts and Claims only to the co-ordinates of the figures. Naturally the solutions of the figures can, according to the invention, also be applied to other positions.

Naturally, the number of auxiliary loudspeakers can be greater than 2, of course in that case the internal space of the system must be designed correspondingly.

The system according to the invention can also contain an integrated sound source, such as an MP3 player, a CD player, or a mobile station equipped with music properties.

The data communications connections between the components of the device according to the invention can be either wired or wireless. Thus, for example the auxiliary loudspeakers 4 can communicate with the main apparatus wirelessly, for example, using Bluetooth or WLAN protocols. According to the invention an infrared connection is also possible.

The invention claimed is:

1. A reflex loudspeaker apparatus, comprising:
a loudspeaker chamber;
a reflex channel connected to the loudspeaker chamber, which connects the loudspeaker chamber to an external space of the reflex loudspeaker apparatus; and
at least one loudspeaker element, which forms part of the structure delimiting the loudspeaker chamber,
wherein the reflex loudspeaker apparatus comprises at least two components, which can be repeatedly detached at least partly from each other, without dismantling, in order to use the loudspeaker chamber as a transportation space.

2. The reflex loudspeaker apparatus according to claim 1, wherein
the loudspeaker apparatus is configured as a briefcase structure,
in an operating state, an inner part of the loudspeaker apparatus acts as a loudspeaker chamber, and
in the transportation state, the inner part acts as a storage and attachment space of auxiliary loudspeakers.

3. The reflex loudspeaker apparatus according to claim 1 or 2, wherein
the at least two components comprise a cover component and a base component, and
the cover component is hinged to the base component.

4. The reflex loudspeaker apparatus according to claim 1 or 2, wherein
the at least two components comprise a cover component and a base component, and
the cover component can be connected to the base component by a catch attachment.

5. The reflex loudspeaker apparatus according to claim 1, wherein the loudspeaker apparatus is sealable for an operating situation.

6. The reflex loudspeaker apparatus according to claim 5, further comprising:
an element fitted to a handle, which when rotated tightens the seal for the operating situation.

7. The reflex loudspeaker apparatus according to claim 6, further comprising:
a locking apparatus comprising a spiral groove configured to tighten a pin-like counter-piece.

8. The loudspeaker apparatus according to claim 1, wherein
the reflex channel is formed as two halves, and
the at least two components include two components each of which contain one of the two halves of the reflex channel.

9. The loudspeaker apparatus construction according to claim 1, further comprising:
an amplifier; and
a handle,
wherein the amplifier, the at least one loudspeaker element, and the handle are located in the same one of the at least two components.

10. The reflex loudspeaker apparatus according to claim 1, further comprising:
a handle,
wherein
one of the at least two components is a base component, and
in an operating situation, the handle detaches from the base of the base component (3), to create a free acoustic radiation space for the at least one loudspeaker element.

11. The reflex loudspeaker apparatus according to claim 1, wherein the apparatus is configured as portable sound-reproduction apparatus.

* * * * *